United States Patent [19]

Kolarik

[11] 4,372,268

[45] Feb. 8, 1983

[54] APPARATUS FOR CONTROLLING FUEL FLOW

[75] Inventor: Oldrich Kolarik, Hagerstown, Md.

[73] Assignee: Mack Trucks, Inc., Allentown, Pa.

[21] Appl. No.: 56,645

[22] Filed: Jul. 11, 1979

[51] Int. Cl.[3] ..... F02M 39/00; F02D 1/04

[52] U.S. Cl. ..... 123/383; 123/382

[58] Field of Search ..... 123/383, 382, 391, 365, 123/379, 372, 373, 367

[56] References Cited

U.S. PATENT DOCUMENTS

| | | | |
|---|---|---|---|
| 2,845,915 | 8/1958 | Frick | 123/372 |
| 4,015,573 | 4/1977 | Okura | 123/383 |
| 4,095,572 | 6/1978 | Scholtz | 123/383 |
| 4,149,507 | 4/1979 | Little | 123/383 |
| 4,248,188 | 2/1981 | Wilson | 123/382 |

*Primary Examiner*—Charles J. Myhre
*Assistant Examiner*—Carl Stuart Miller
*Attorney, Agent, or Firm*—Bernard, Rothwell & Brown

[57] ABSTRACT

A fuel controller to retard rate of increase in fuel flow during acceleration when corresponding intake pressure is not at a desirable level. Particularly in turbocharged engines, during periods of acceleration, increase in air pressure lags behind the increased fuel flow. This results in a fuel rich mixture which produces a "puff" of exhaust smoke when combusted. The controller retards the increase in fuel flow to minimize this lag and reduce exhaust smoke which would otherwise occur.

5 Claims, 8 Drawing Figures

APPARATUS FOR CONTROLLING FUEL FLOW

BACKGROUND OF THE INVENTION

It is well known that turbocharged diesel engines yield a puff of smoke when accelerated rapidly from a low speed and/or low load condition. This results from the inability of the turbocharger to keep pace with the increase in fuel supplied during acceleration. The result is a temporary fuel-rich combustion which produces a "puff" of exhaust smoke.

Due to environmental concerns, particularly in recent times, various approaches have been made with various degrees of success to minimize this problem which otherwise, especially in vehicle applications, would cause turbocharged diesel engines to be objectionable. One of the approaches is based on the use of a pneumatic device that limits the fuel quantity to a low level whenever the air pressure in the intake manifold is low and allows for more fuel quantity (up to a preset fixed fuel schedule) as the pressure increases. Even though this approach is fairly simple and has produced some success in the control of acceleration smoke, it is rather restrictive on engine torque available during acceleration. The reason is that during acceleration the turbocharger has to speed up and develop a sufficient pressure before the device can start responding and allow for any increase in the fuel flow. Until such time, the engine torque is limited to a minimum. During acceleration the torque increase always lags behind the turbocharger, a characteristic inherent to pressure sensing puff limiting devices.

SUMMARY OF THE INVENTION

The present invention overcomes the problems noted above that are associated with the acceleration of diesel engines. More particularly, the invention concerns a control device that serves to limit the rate of increase of the amount of fuel supplied to the engine during periods of acceleration and/or increase of load so that the amount of fuel actually passed into the engine cylinders, at any point of time, corresponds more closely to that which is appropriate for combustion with the increasing amount of available air without producing undue amounts of exhaust smoke. This control device can, for convenience, be referred to as a smoke or puff limiter.

Most diesel engines are equipped with a system for supplying fuel to the engine cylinders that includes a fuel injection device having a projecting control rack whose linear position or displacement corresponds to the amount of fuel being delivered to the engine cylinders. The smoke limiter of the present invention serves to control fuel flow to the engine by fluidly restricting the rate of displacement of the fuel injection control rack so that the rate of increase of the amount of fuel delivered to the engine corresponds more closely to the rate of increase of the amount of air that is delivered to the engine cylinders by the accelerating turbocharger even though the operator of the engine may reset the engine accelerator or governor into a position of a greater amount of fuel more rapidly.

More particularly, movement of the fuel injection control rack towards positions of greater fuel delivery is resisted by the biasing force of a pressure-actuated, hydraulic piston having liquid contained in at least two chambers between which fluid flow is restricted. The rate at which this biasing force is overcome to permit greater displacement of the fuel injection control rack for greater fuel delivery, is primarily a function of the pressure delivered by the control rack force and the rate of the restricted fluid flow between the chambers in response to such pressure. Additionally, the intake manifold pressure is applied towards overcoming the biasing force of the fluid piston, primarily in order to prevent the smoke limiter from affecting the fuel injection control rate when turbocharger acceleration is completed and a sufficient intake manifold pressure is reached for a particular fuel flow. This assures that there is no distrubing force acting on the fuel injection control rack and that the governor regains full control of the engine at steady state operating conditions.

As the forces counteracting the biasing force of the fluid piston towards restriction of control rack movement increase during a period of engine acceleration, the biasing force against the fuel pump control rack decreases to permit greater displacement of the rack towards positions of greater fuel delivery to the engine. In this manner the amounts of fuel and combustion air supplied to the engine cylinders more closely correspond to the ratio needed to avoid insufficient combustion and undue exhaust smoke. Thus, the rate of fuel increase to the engine cylinders has a schedule that is better suited to the acceleration in the amount of combustion air supplied to the engine. The smoke limiter is operatively engaged with the fuel injection control rack at low manifold pressure and high fuel quantity demand, and is disengaged at steady state operating conditions when intake manifold pressures are sufficient for any given fuel flow.

The engine control method and apparatus of the invention can be embodied in the forms shown in the drawings and described in appropriate detail below. In a general sense, movement of the fuel injection control rack to positions of greater fuel delivery is restricted by contact with a rod or shaft extending from the smoke limiter. The extending rod is moved linearly by the pressure-actuated, biasing force of a fluid piston. The fluid is divided between enclosed chambers and fluid flow is permitted between the chambers. Such flow is more restricted in the direction permitting greater control rack displacement and, therefore, greater fuel delivery to the engine. A principal controlling force for this movement of fluid is the applied force of the fuel injection control rack. The device is constructed so that at the intake manifold pressure corresponding to engine steady state operating conditions contact between the control rack and the rod extending from smoke limiter is disengaged and remains so until a sequence of sufficiently low intake manifold pressure followed by a sufficient and rapid acceleration and/or increase of load takes place. During movement of the fuel injection control rack towards a position of lesser extension from the fuel injection controller and lesser fuel delivery, liquid in a chamber of the fluid piston moves relatively freely back into the chamber from which there had been restricted flow during engine acceleration. The smoke limiter is thereby placed in a position to again control engine acceleration and reduce the amount of exhaust smoke during such acceleration periods.

The method and apparatus of the invention, therefore, provide for simple and effective, fluid control of the schedule of fuel supplied to the cylinders of a diesel engine during acceleration. Accordingly, the discharge of undue smoke into the atmosphere and its polluting effects can be effectively reduced. Moreover, the device can be readily adapted for use with existing engines with a minimum of expense and alteration and with little, if any, adverse effect on the operation of the engine.

DETAILED DESCRIPTION OF THE PREFERRED EMBODIMENTS

Figure 1:
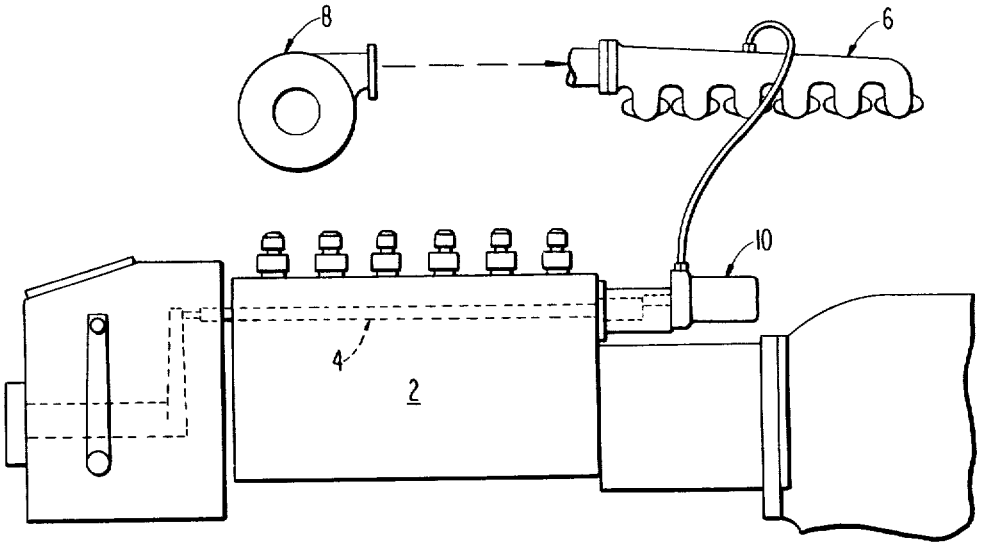
FIG. 1 is a schematic of the smoke limiter in conjunction with the engine components related to the smoke control process.
Figure 2:
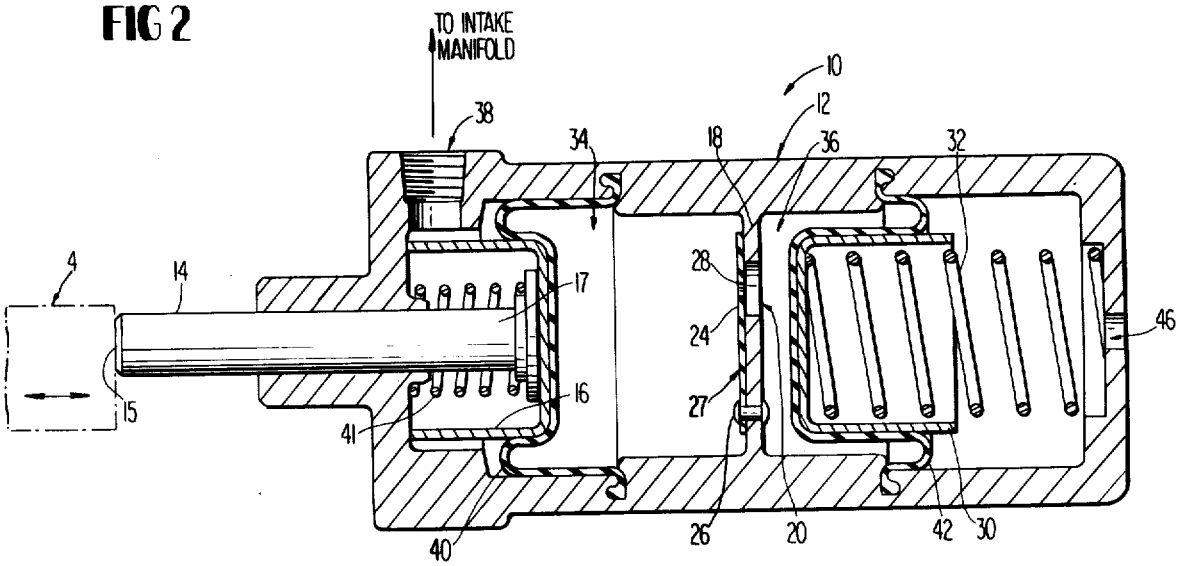
FIG. 2 is a cross-sectional view of one embodiment of the control apparatus.

Referring to FIG. 1, there are shown some of the elements typically employed in controlling the fuel and air delivery to internal combustion engine, particularly diesel engines. Fuel pump 2, is employed with the engine to pump the fuel under pressure into each individual cylinder. For controlling the fuel flow, a control rack 4 is integrated with the fuel pump of the injection system and an actuating means such as a governor and accelerator to change the operation of the fuel pump and ultimately the flow of fuel. A manifold 6 receives air under pressure from turbocharger 8 and distributes the air to each individual cylinder for combustion with the fuel provided by the fuel pump. The smoke limiter 10 acts with the foregoing members to control the increase in fuel flow during acceleration so that a schedule of increase in fuel flow corresponds more closely with the rate of turbocharger acceleration to reduce engine smoke. As shown in FIG. 2, movement of the control rack to the right indicates increase in fuel flow while movement of the control rack in the opposite direction corresponds to a decrease in fuel flow. Smoke limiter 10 includes a housing 12 with a locating rod or shaft 14 movable relative to the housing and having an exposed end 15 for engaging the control rack 4 at different positions along the path of movement of control rack 4, at least partly, as a function of the manifold pressure. The other end 17 of the locating shaft 14 is secured to a piston 16 which moves within the housing 12.

As can be seen in FIG. 2, housing 12 is divided into two chambers 34, 36 by a wall member 18. A relatively large passage 20 extends through the wall 18 and establishes a flow path between the two chambers formed by the wall. A check valve 27 includes a flexible plate 24 attached to the left side of wall 18 by rivet 26, such that plate 24 can only flex or bend away from passage 20 toward the left or chamber 34. An orifice 28 is provided in the plate 24 in communication with the passage 20. Orifice 28 is substantially smaller than the passage 20 to significantly restrict the flow rate of fluid from the left or first chamber 34 to the right or second chamber 36 which houses piston 30 for movement therein. With this configuration, when fluid is pressurized in a manner which causes flow from the second chamber 36 to first chamber 34, the plate will bend away from the passage 20 to allow increase in fluid flow over that which would otherwise occur if it had to flow solely through the orifice 28. On the other hand, when the pressure is reversed, plate 24 is pressed against the wall 18 and fluid is permitted to flow only through orifice 28 at a much reduced rate.

The movement of the fluid through the orifice 28 in the passage 20 in cooperation with the intake manifold pressure and the other elements of the smoke limiter 10 serve to position the locating shaft 14 along the path of movement of the control rack 4 depending on the intake manifold pressure as well as to define the schedule for movement of the control rack once it has engaged the locating shaft during acceleration. To achieve this purpose, the pistons are arranged in sealing relationship with the side walls of the chambers defined in the housing. Specifically, with reference to FIG. 2, an outer surface of piston 16 is connected to a flexible first diaphragm 40 of the rolling type and the back side of piston 16 is fixed to locating shaft 14. Diaphragm 40 is sealed to the side walls of first chamber 34 approximately midway between the left end and wall 18 of housing 12. To maintain piston 16 in contact with diaphragm 40, an optional auxiliary spring 41 is employed; but, such contact can be secured by any other convenient means. First diaphragm 40 is one which allows movement equal to the stroke of the shaft 14 within chamber 34. Intake manifold pressure port 38 is provided through the exterior of housing 12 to expose the rear side of piston 16 to manifold pressure with the forward side of the piston being in communication with fluid in first chamber 34. Similarly, second piston 30 includes a flexible seal of the rolling diaphragm type to form a second diaphragm 42 in sealing engagement with the internal walls of housing 10 at a position approximately midway between the right end of the housing and wall 18. Mainspring 32 is included between piston 30 and the right end of housing 10 to continuously bias piston 30 in a direction toward wall 18 and first piston 16. The rear side of the piston 30 is exposed to the atmosphere through vent 46 in the right end of the housing while the front portion of the second diaphragm 42 is in communication with the fluid in second chamber 36.

The force developed by mainspring 32 on second piston 30 is designed so that when manifold pressure on first piston 16 is sufficiently low and relatively little or no force is developed by control rack 4 on locating shaft 14, spring 32 acting on piston 30 imparts pressure on the liquid in chamber 36 high enough for the check valve 27 to open and liquid to flow relatively rapidly into first chamber 34. This action will overcome the force of spring 41 until shaft 14 is fully extended. There are intermediate positions where the manifold pressure is such that pressure imparted to piston 16 through port 38 will equal that produced by the main spring 32. This equilibrium situation will stop movement of piston 16 and ultimately shaft 14. This movement to the left caused by the action of main spring 32 is referred to as the return action of the puff limiter.

Spring 32 acting on second piston 30 will be compressed under the action of the control rack force applied to the locating shaft 14, to raise the pressure in chamber 36. This is accomplished by forcing the liquid in first chamber 34 under pressure of piston 16 through orifice 28 into second chamber 36. Because the flow of liquid through orifice 28 is relatively slow, the movement of piston 16 through chamber 34 is restricted from what it would be otherwise; correspondingly, the movement of control rod 4 is restricted during those periods of acceleration when it is engaged with shaft 14. This restriction of movement will continue until travel of locating shaft 14 under the action of control rod 4 has ceased in the direction of increased fuel flow. The rate of this process, which is controlled by the orifice size and the pressures on the fluid within the chambers, is matched with the rate of turbocharger acceleration so that the engine's exhaust smoke is acceptable.

During acceleration, increase in fuel flow is accompanied by a corresponding increase in manifold pressure. The exposure to this pressure of piston 16 aids in the completion of shaft retraction; however, the main purpose of this manifold pressure is to disengage the puff limiter locating shaft 14 from the control rack 4. The latter feature keeps the puff limiter 10 out of contact with control rack when steady-state turbocharger speed is achieved even though the force of control rack 4 on shaft 14 disappears. Thus, the manifold pressure on piston 16 acts as a locator in conjunction with spring 32 to position shaft 14 at different points in the path of travel of control rod 4 as a function of fuel flow.

The following is a general explanation of the operation of the above-described puff limiter. At idle, the manifold pressure and the fuel flow are low, therefore the puff limiter locating shaft 14 is fully extended under the action of spring 32 applying pressure in the liquid to force piston 16 leftward. The control rack 4 is positioned away from shaft 14 as dictated by an injection system governor. When the engine is commanded to accelerate, the governor causes control rack 4 to move rapidly toward maximum fuel flow until rack 4 impacts on extended locating shaft 14. At that impact or engagement, the control rack 4 encounters a resistance developed by the puff limiter. This resistance is caused by piston 16 being engaged with the liquid in chamber 34 and forcing it at a very slow rate through orifice 28. This resistance force is generated by a pressure difference between chambers 36 and 34 as liquid flows through orifice 28. The control rack 4 velocity will be slowed to a level which is dictated by the balance between the governor force exerted on control rack 4 and the resisting force of puff limiter 10.

During this acceleration period, an increase in intake manifold pressure is developed by the accelerating turbocharger. Correspondingly, there is an increase in the retracting force acting on shaft 14 and in the resulting rate of retraction until a point is reached where the governor will stop further fuel flow increase. At this point, the puff limiter locating shaft 14 separates from control rack 4 and keeps retracting due to intake manifold pressure until either equilibrium of forces of the intake manifold pressure and the mainspring 32 are achieved or a full puff limiter stroke is achieved.

When the engine is commanded to rapidly decelerate, for example during a gear shift, the governor causes control rack 4 to move rapidly toward the left, a no-fuel position. Under these conditions, where the movement of control rack 4 to the left is greater than that of locating shaft 14, control rack 4 will remain disengaged from locating shaft 14. During deceleration, the turbocharger speed is reduced, and, therefore, the intake manifold pressure is reduced. This, of course, is reflected on the rear side of piston 16 allowing mainspring 32 force to overcome the manifold pressure force on piston 16. Specifically, there is a departure from equilibrium position to a condition where the pressure in chamber 34 is lowered relative to that in 36. Thus, liquid under pressure of piston 30, which in turn is biased by spring 32, will flow through passage 20 into chamber 34. This displaces piston 16 to the left and moves shaft 14 toward a fully extended position. Since the check valve 27 opens during this process the flow of liquid from chamber 36 to chamber 34 occurs much more rapidly than in the reverse direction. As a result, travel of shaft 14 toward the extended position occurs more rapidly than retraction, and the puff limiter becomes ready to perform the control steps of the next acceleration cycle. The amount of extension depends on the residual manifold pressure at the end of deceleration. The more pressure, the less shaft extension, which means more of engine torque is immediately available at the beginning of the next acceleration cycle. But even if the shaft is fully extended as would be the case in a long period of time for a gear shift, only little or no torque reduction can be noticed during the subsequent acceleration since the puff limiter locating shaft 14 then starts retracting without any hesitation and full engine torque operation is achieved in a few seconds.

Figure 3:
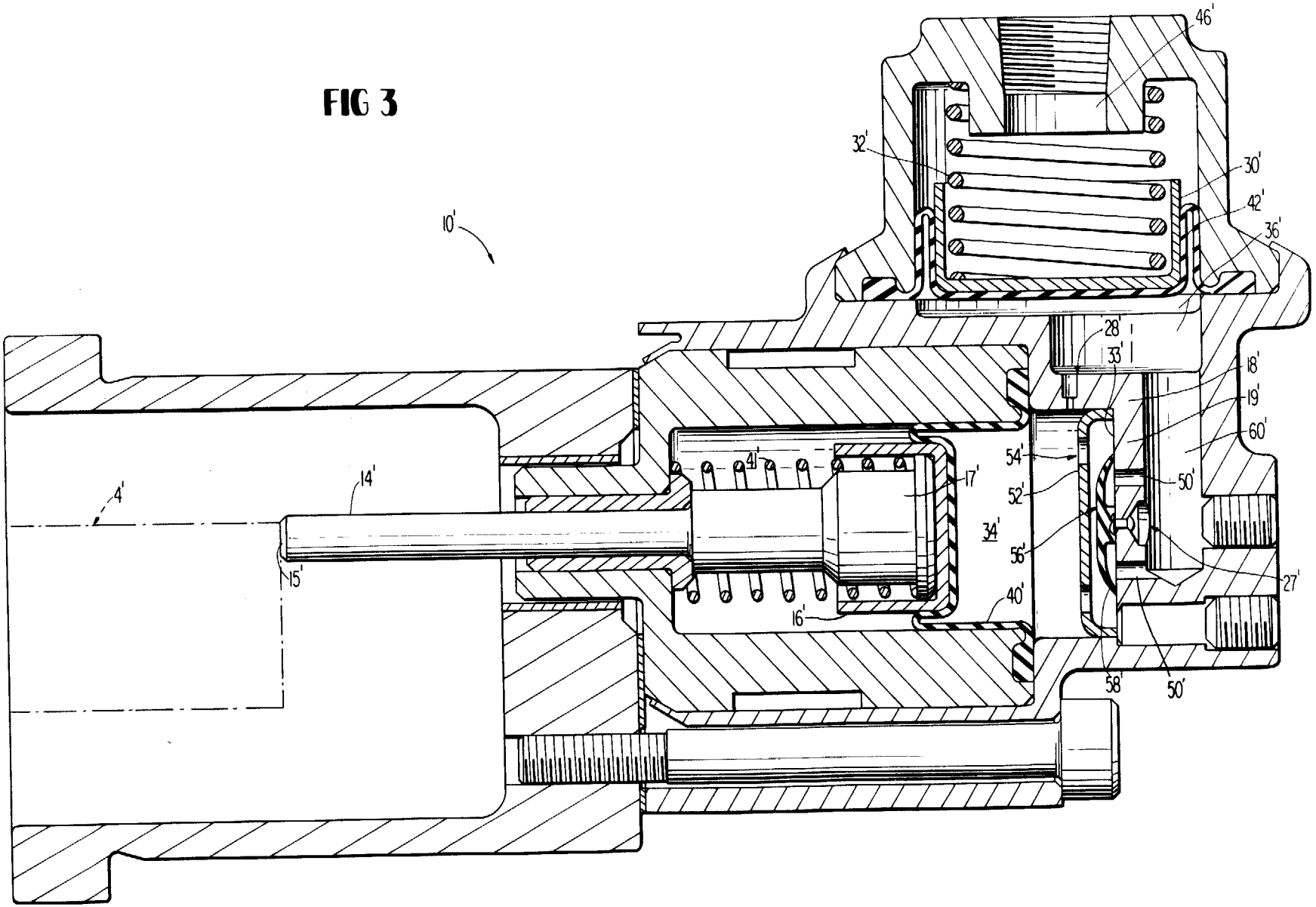
FIG. 3 is a cross-sectional view of another embodiment of the control apparatus taken along lines 3—3 of FIG. 5.
Figure 4:
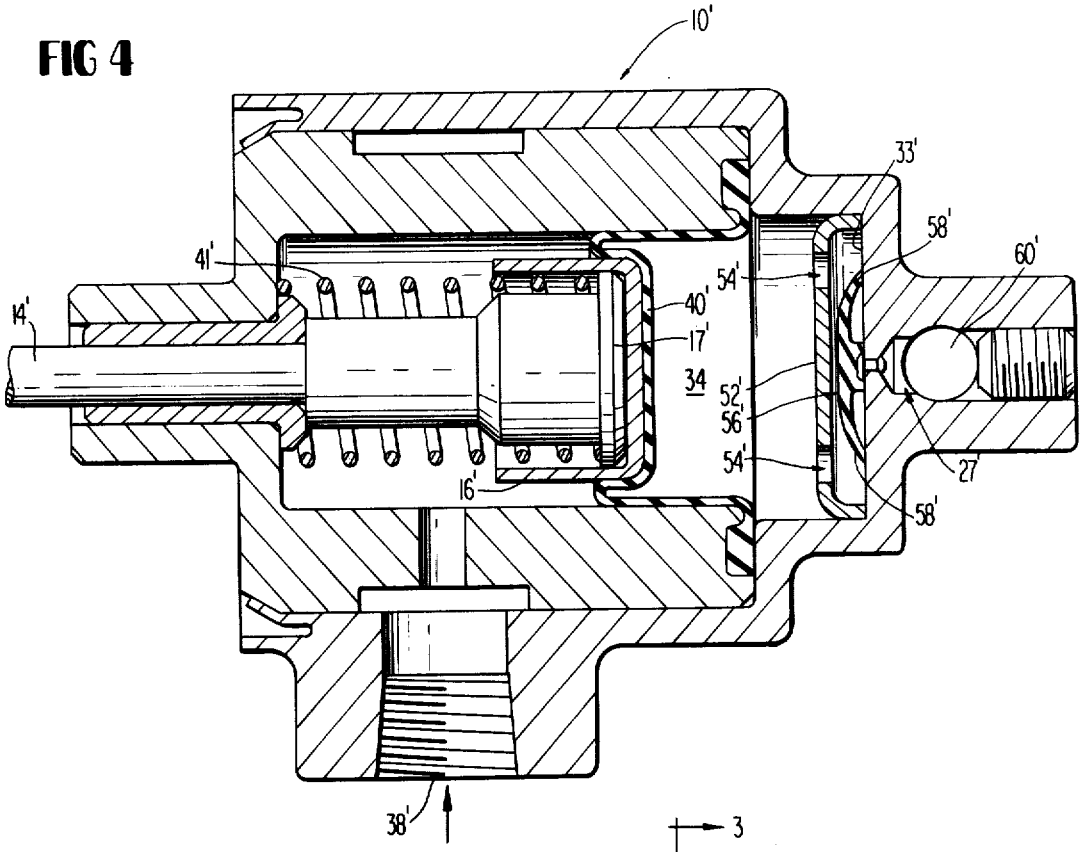
FIG. 4 is a cross-sectional view of the control apparatus taken along lines 4—4 of FIG. 5.
Figure 5:
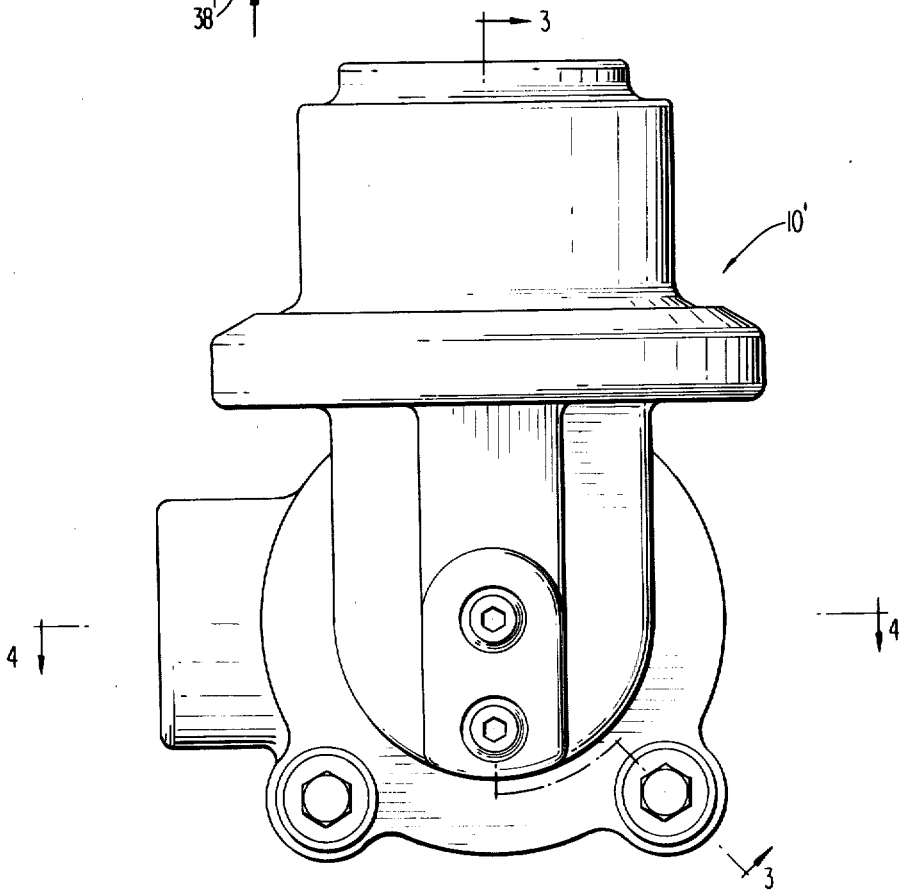
FIG. 5 is a side view of the apparatus shown in FIGS. 3 and 4.

In FIGS. 1 and 2, a preferred embodiment is shown in which the housing 12 is cylindrical in configuration with pistons 30 and 16 both moving along a common longitudinal axis. Another embodiment which works in substantially the same way as the embodiment described above is shown in FIGS. 3–5. The reference numbers used in discussing the embodiment shown in FIGS. 3–5 are primed to distinguish them from the reference numerals used in FIGS. 1 and 2. Similar reference numbers, represent like parts in each embodiment.

The smoke limiter 10' of the embodiment shown in FIGS. 3 to 5 includes a first piston 16' having a first diaphragm 40' for movement in a first chamber 34'. Similarly, a second piston 30' having a second diaphragm 42' moves in second chamber 36'. The rear side of piston 16' is exposed to manifold inlet pressure through intake manifold pressure port 38'. Unlike the embodiment discussed above, the movement of pistons 16', 30' as well as the configuration of housing 12' are not symmetrical. The portion of housing 12' defining second chamber 36', as can be seen in FIG. 3, is substantially at right angles to that portion of housing 12' defining first chamber 34'. Accordingly, wall member 18' extends along the top portion of first chamber 34' rather than being perpendicular to the common axis of piston movement shown in FIG. 2. In addition, check valve 27' is located at the end of chamber 34' in wall 19' perpendicular to wall member 18' and is connected to chamber 36' through vertical conduit 60'.

The check valve 27' has a different configuration than that described in connection with FIG. 1. Specifically, check valve 27' includes two passages parallel to the axis of travel for first piston 16', parallel to one another, and displaced from the axis of the first chamber of the housing 12' having first chamber 34'. In chamber 34', a cup member 52' completely encompasses the passages 50' and, in addition, defines two cup passages 54' parallel to one another and parallel to but displaced from passages 50'. In this way, a protective cover is provided for the passages as well as other elements of the valve described hereinafter while still allowing flow of fluid therethrough.

Fixed to inner surface 33' at the end of chamber 34' is a flexible, dome-shaped valve member 56' having an outer periphery 58' which encompasses passages 50'. The dome-shaped member 56' is sufficiently flexible that when fluid is placed under pressure in chamber 36' greater than that in chamber 34', the periphery 58' will be forced away from the surface allowing the fluid to flow around the dome-shaped member and through the cup passages 54'. On the other hand, where the pressure in chamber 34' is greater than that in 36', the periphery will be forced flush against the end surface 33' preventing any fluid from flowing through passages 50'. As a result, the only flow path between the chambers would be through orifice 28' which connects chamber 34' to chamber 36' through wall 18' along top portion of housing 12', as shown in FIG. 3. With this configuration, during acceleration in which the turbocharged maifold pressure lags behind the corresponding fuel flow, the fluid is forced through only the orifice 28' into chamber 36' at a schedule corresponding to that discussed above which closely corresponds to the increase in turbocharger pressure. When the pressure diminishes, a reverse flow occurs more quickly since the fluid can flow through orifice 28' and passages 50' and around check valve 27'.

As with the earlier embodiment, the rear portion of piston 30' is subjected to the atmosphere through port 46'. However, in both of these embodiments in lieu of the mainsprings 32 and 32', pressurized gas can be used in which case the chamber behind second piston 36' would be sealed to maintain the gas within the housing.

Figure 6:
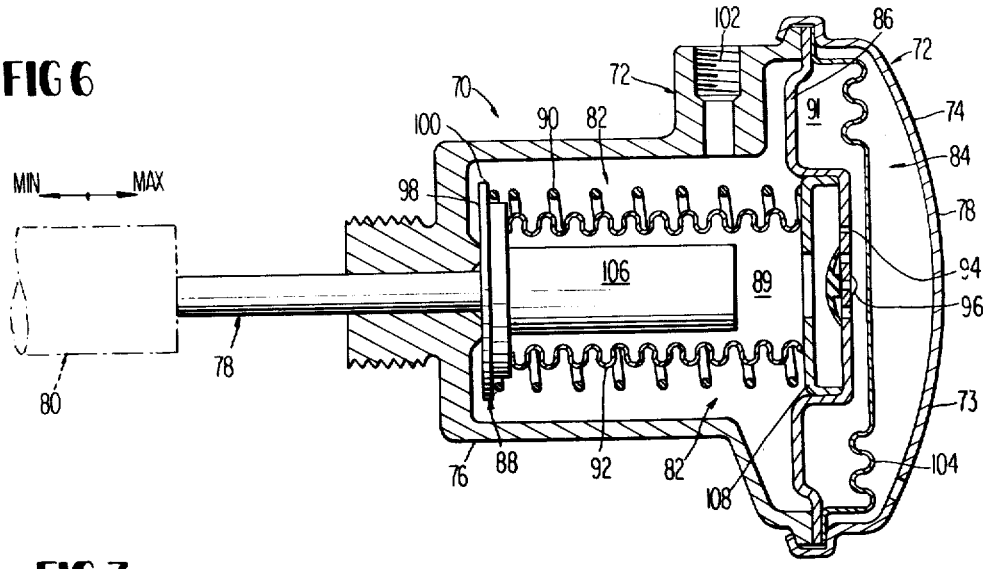
FIG. 6 is a cross-sectional view of another control apparatus of the invention.

Another embodiment, as shown in FIG. 6, demonstrates a puff limiter having a feature of compactness along with other features which characterize the invention. Housing 72 of puff limiter 70, having a generally mushroom-shaped configuration, includes a head portion 74 and a stem portion 76. The head 74 is circular in configuration and has a convex outer portion 73. Extending from the center of this head toward the control rack 80 is stem 76 which defines the remaining portion of the housing 72. Housing 72 is divided into two chambers 82, 84 by partition wall 86, which is attached to housing 72 at the center of head 74.

Locating shaft 78 extends into first chamber 82 defined primarily by the stem 76 and the partition wall 86. Part of locating shaft 78 extends outside of the housing for engagement by control rack 80 in a manner similar to that described with the other embodiments discussed earlier. The portion of the locating shaft 78 extending within the first chamber is attached to a piston member 88. A helical spring 90 is located between the piston member 88 and guard member 108 attached to partition wall 86 such that the spring is in continuous engagement with the piston member 88 to bias the latter away from partition wall 86 and toward the control rack 80. Also attached between the guard member 108 and the piston member 88 is a metal bellows 92 which has one end sealingly fixed to the piston member 88 and the other end sealingly fixed to guard member 108 to define a fluid-filled chamber 89. The metal bellows 92 is completely surrounded by the spring 90 such that they are both compressed and extended during movement of the piston toward and away, respectively, from partition wall 86 during operation of the puff limiter. A second bellows 104 extends throughout the second chamber 84 and is sealingly secured to the periphery of the second chamber to divide that chamber between the partition wall 86 and the outer convex wall 73 of head 74. This forms a second fluid-filled chamber 91 between partition wall 86 and second bellows 104.

An orifice 94 is provided in partition wall 86 between chambers 89 and 91. Adjacent orifice 94 is a check valve 96 which allows flow of fluid from second chamber 91 into first chamber 89, but prevents flow in reverse direction. Thus, when hydraulic fluid is contained within the volume of the two chambers 89, 91 the flow of fluid will be restricted from first chamber 89 into second chamber 91 by orifice 94 but will flow much more rapidly from the second 91 into first chamber 89 through check valve 96 and orifice 94. These flow characteristics are similar to those described in connection with FIGS. 1, 2 and 3.

The piston 88 includes a front surface 100 to which there is sealingly secured first bellows 92 and on which spring 90 is seated. A rear surface 98 of piston 88 with the exception of the area of locating shaft 78 is exposed to the remainder of chamber 82. Air inlet 102 is provided in housing 70 to communicate the air intake manifold pressure to first chamber 82 entirely about metal bellows 92. Because the cross sectional area of piston rear surface 98 exposed to the air pressure within first chamber 82 is greater than that of the piston front surface 100, an increase in the air pressure above the pressure provided by the spring force of spring 90 will act over a larger cross sectional area to drive pistion 88 and the locating rod 78 toward the partition wall 86. This movement will continue, as in the other devices described earlier, until the air pressure and spring pressure reach an equilibrium point and locating shaft 78 is out of force contact with control rack 80 or the locating shaft has moved through a full stroke.

During movement toward the partition wall 86 the hydraulic fluid under pressure within the first metal bellows 92 will flow through the orifice 94 into second chamber 91. This of course will cause the second set of bellows 104 to expand to accommodate the increased volume of hydraulic fluid. Upon the reduction of air intake pressure, piston 88 under the action of main spring 90, will tend to revert to the fully extended position for shaft 78. As a result of the changes in pressure between the different chambers which arise from this condition, check valve 96 will open to permit hydraulic fluid in second chamber 91 to flow at a much faster rate into first chamber 89. The first bellows 92 and second bellows 104 will expand or shrink, accordingly, to their original sizes to accommodate the volumes of hydraulic fluid in their chambers 89 and 91.

Because it is desirable to have the locating shaft 78 move as quickly as possible to its fully extended position, it is advantageous to have a limit on the movement of the locating rod toward the partition wall 86 when under the action of relatively higher air intake pressures. For this purpose a stroke-limiting extension 106 is provided on front surface 100 of piston 88 to extend toward partition wall 86 such that, when the desired stroke is achieved, extension 106 will engage the guard 108 to prevent further movement. Otherwise, if the locating shaft was permitted to move through a stroke greater than needed into chamber 82, the return stroke would have to cover a greater distance and thus take longer time. The quicker locating shaft can return to a more extended position, the less likelihood that control rack 80 will move freely toward increased fuel flow during those periods when it should be engaged by the puff limiter locating rod or shaft 78.

In this particular embodiment, guard 108 surrounds orifice 94 and check valve 96 to prevent extension 106 from interfering with the operation of these elements. The length of the extension in this embodiment, can be one which allows a full stroke of about 0.3 to 0.4 inch.

Figure 7:
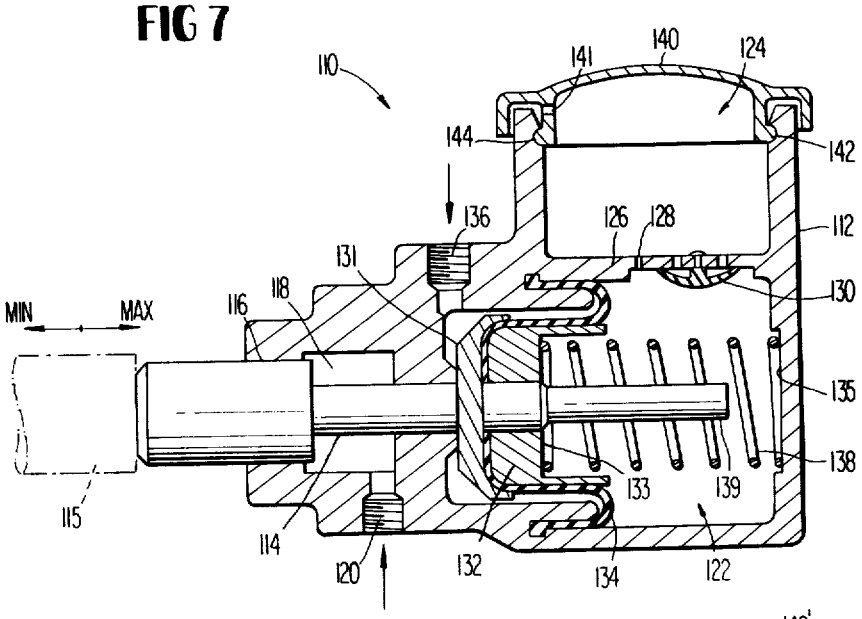
FIG. 7 is a cross-section view of a fourth embodiment showing a refillable control apparatus.

The puff limiters described above are completely sealed. This insures that the desired pressures are maintained in all the chambers and leakage is kept to a minimum. In FIG. 7 there is shown a puff limiter that is refillable which allows the introduction of additional hydraulic fluid should any leakage or other reduction of fluid occur in this system. In the embodiment of FIG. 7 there is shown a refillable puff limiter 110 including a housing 112 which is generally L-shaped in configuration. The vertical portion of the "L" provides easy access to at least one of the chambers for adding hydraulic fluid as needed.

As with the other embodiments discussed above a locating shaft 114 is provided to move relative to the housing 112 depending on intake manifold air pressure and engagement of control rack 115 with locating shaft 114. An additional feature provided in this embodiment, which could also be included in the other embodiments, is an override system. For this purpose, override piston 116 is attached to locating shaft 114 for movement in override cylinder 118. A pressure inlet 120 communicates with the override cylinder 118 and is adapted to be connected to an override air pressure line in any convenient manner. In this way the action of the intake manifold pressure in moving locating shaft 114 away from the control rack 115 can by overridden by application of sufficient pressure to inlet 120 and cylinder 118 to override the control functions of the hydraulic control device.

The override feature provides an additional feature for those driving operations where it is not desirable for the locating shaft 114 to be positioned out of contact with control rack 115 regardless of the intake manifold pressure. For example, when in reverse or low forward gears it is desirable to prevent undue torque delivery from the transmission. In these gear positions the override system can be actuated to lock the locating shaft into a fully extended position and limit control rack movement and ultimately fuel flow. Such a limitation on fuel effects a corresponding limit on torque. This override feature can be included in a system to actuate and deactuate automatically depending on the gear ratio chosen by the operator.

In housing 112 there is a first chamber 122 and a second chamber 124 located in the "L" above the first chamber 122 and separated therefrom by a wall or a floor member 126. As with the other embodiments, wall 126 includes orifice 128 and check valve 130 to restrict flow of fluid from first chamber 122 into second chamber 124, but to allow reverse flow from the second chamber 124 into the first chamber 122 at an increased rate.

Except for the location of these two chambers, their operation is substantially identical to that of puff limiters described earlier; however, the piston configuration and various other elements in chamber 122 may be different. For example, the piston 132 is attached to the internal walls of the first chamber 122 by rolling diaphragm 134. The rear side 131 of piston 132 as well as rolling diaphragm 134 are in communication with the air intake pressure inlet 136 such that the application of manifold air intake pressure is transmitted directly to the rear surface of piston 132. Front surface 133 of piston 132 is engaged by main spring 138 which extends between the piston 132 and an opposite wall 135 of first chamber 122 to bias piston 132 toward control rack 115. As before, either under the action of intake manifold pressure or the application of the control rack, piston 132 can be moved into the first chamber 122 thereby forcing the liquid therein upwardly through orifice 128 into second chamber 124. Also, an extension 139 is provided extending from front surface 133 into first chamber 122 to limit the stroke of piston 132 in same manner as extension 106 of the embodiment shown in FIG. 6.

The top portion of the second chamber 124 is provided with a removable lid 140 which can be snapped in place or otherwise releasably fixed to the top of the housing in any convenient manner. As shown, lid 140 is provided with circular lip member 142 which engages recess 144 in the walls of the second chamber 124 and permit the lid to simply be snapped into place. Lid 140 includes an air vent 141 such that the hydraulic fluid within second chamber 124 is subjected to atmospheric pressure. With this configuration, should the hydraulic fluid be reduced for some reason, lid 140 can be quickly removed to facilitate access to second chamber 124. Because of the location and configuration of the second chamber, the volume of hydraulic fluid can be increased to a desired level and the lid replaced.

Figure 8:
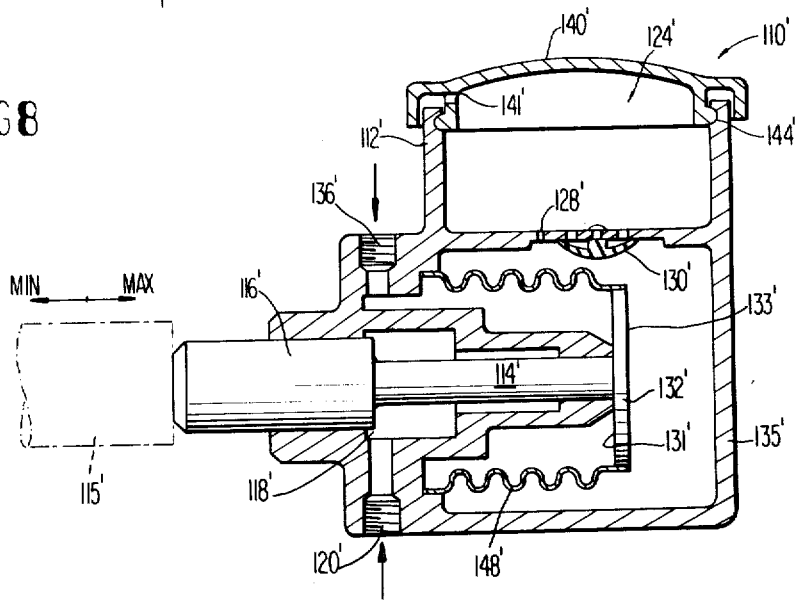
FIG. 8 is a cross-section view of a fifth embodiment showing another type of refillable control apparatus.

Another embodiment using a refillable type housing is shown in FIG. 8. Since many of the elements of FIG. 8 are essentially the same as those of FIG. 7, they will not be reiterated but are simply numbered in prime form so that the similarities can be readily appreciated. The major differences between these embodiments is the elimination of the main spring 138 and rolling diaphragm 134. These elements are replaced by a metal bellows 148' which has sufficient resiliency to act as a spring in returning the locating shaft 114' upon reduced intake manifold pressure. As with the embodiment of FIG. 7, the intake manifold pressure is applied to rear surface of the piston to move it into the first chamber and force the liquid upwardly into the second chamber.

The latter configuration of course reduces the number of elements required for operation of the puff limiter without significant loss in efficiency and operation. As a result a compact, efficient and yet more economical device can be achieved. This type of metal bellows having the needed spring force can be used with other embodiments described earlier; however, there may have to be other changes in the configuration to accommodate the metal spring bellows in lieu of the type of bellows and the main spring which have characterized the other embodiments.

What is claimed is:

1. An apparatus for controlling a fuel flow to a diesel engine comprising:

(a) a housing;

(b) a locating member having a first portion projecting from said housing for engagement by a fuel control member and a second portion extending into said housing and reciprocally moveable therein;

(c) said housing having first and second chambers for containing hydraulic fluid, said chambers being positioned for fluid flow therebetweeen;

(d) a movable member, arranged for movement within said first chamber in sealing relationship therewith, said movable member connected to said locating member and arranged for transmitting pressure imparted to the second portion of said locating member to fluid in said first chamber;

(e) means for restricting flow of fluid from said first chamber into said second chamber to retard movement of said locating member in a controlled manner into said housing and permitting movement of said locating member in a substantially unrestricted manner away from said housing; and (f) an override connecting means for applying pressure to said locating member in a direction of greater extension of said locating member from said housing, said pressure being greater than the pressure urging said locating member in the direction of lesser extension of said locating member from said housing.

2. Apparatus for controlling the fuel delivered to diesel engine comprising;

(a) a fuel pump for delivering fuel to the engine;

(b) said fuel pump being operatively connected to a movable member for controlling the rate of fuel flow to the engine whereby movement in a first direction increases fuel flow and movement in an opposite direction decreases fuel flow;

(c) a turbocharger for delivering intake air under pressure to the engine;

(d) a manifold for receiving air from the turbocharger and distributing it to cylinders in the engine;

(e) a housing;

(f) a locating member having a first portion engageable with said movable member for engagement by a fuel control member and a second portion extendable into said housing, said locating member being movable along the path of said movable member;

(g) said housing having first and second chambers for containing hydraulic fluid, said chambers being positioned for fluid flow therebetween;

(h) a pressure transmitting means, arranged for movement within said first chamber in sealing relationship therewith, said pressure transmitting means connected to said locating member and arranged for transmitting pressure imparted to the second portion of said locating member to fluid in said first chamber;

(i) means for restricting flow of fluid from said first chamber into said second chamber to retard movement of said locating member in a controlled manner into said housing and permitting movement of said locating member in a substantially unrestricted manner away from said housing; and (j) an override connecting means for applying pressure to said locating member in a direction of greater extension of said locating member from said housing, said pressure being greater than the pressure urging said locating member in the direction of lesser extension of said locating member from said housing.

3. An apparatus for controlling fuel flow to a diesel engine comprising:

(a) a housing;

(b) a locating member having a first portion projecting from said housing and a second portion extending into said housing and reciprocably movable therein;

(c) said housing having first and second chambers for containing hydraulic fluid, said chambers being positioned for fluid flow therebetween, said first chamber being positioned for transmitting pressure imparted to said second portion of said locating member to fluid in said first chamber;

(d) means for restricting flow of fluid from said first chamber into said second chamber to retard movement of said locating member into said housing;

(e) connecting means for connecting said housing to the intake air supply of a diesel engine, said connecting means being positioned to transmit pressure of said intake air to fluid in said first chamber; and (f) override connecting means for applying pressure to said locating member in a direction of greater extension of said locating member from said housing, said pressure being greater than the pressure urging said locating member in the direction of lesser extension of said locating member from said housing.

4. Apparatus for controlling the fuel delivered to diesel engine comprising:

(a) a fuel pump for delivering fuel to the engine;

(b) said fuel pump being operatively connected to a movable member for controlling the rate of fuel flow to the engine whereby movement in a first direction increases fuel flow and movement in an opposite direction decreases fuel flow;

(c) a turbocharger for delivering intake air under pressure to the engine;

(d) a manifold for receiving air from the turbocharger and distributing it to cylinders in the engine;

(e) a housing;

(f) a locating member having a first portion engageable with said movable member and a second portion extendable into said housing, said locating member being movable along the path of said movable member;

(g) said housing having first and second chambers for containing hydraulic fluid, said chambers being positioned for fluid flow therebetween, said first chamber being positioned for transmitting pressure imparted to said second portion of said second locating member to fluid in said first chamber;

(h) means for restricting flow of fluid from said first chamber into said second chamber to retard movement of said locating member into said housing;

(i) connecting means for connecting said housing to the air from the turbocharger, said connecting means being positioned to transmit pressure of said turbocharger air to fluid in said first chamber; and (j) an override connecting means for applying pressure to said locating member in a direction of greater extension of said locating member from said housing, said pressure being greater than the pressure urging said locating member in the direction of lesser direction of said locating member from said housing.

5. The apparatus according to claim 1 or 2 wherein said override means includes cylinder means in said housing, an override piston means operatively associated with said locating member and in communication with said override cylinder, said connecting means communicating with said override cylinder.

* * * * *